United States Patent [19]

Refabert

[11] Patent Number: 4,954,118

[45] Date of Patent: Sep. 4, 1990

[54] FLEXIBLE BODIED DOLLS

[75] Inventor: Jacques Refabert, St Cyr Sur Loire, France

[73] Assignee: Corolle S.A., France

[21] Appl. No.: 414,030

[22] Filed: Sep. 28, 1989

[30] Foreign Application Priority Data

Sep. 30, 1988 [FR] France ..... 88 12820

[51] Int. Cl.[5] ..... A63H 3/46; A63H 3/02

[52] U.S. Cl. ..... 446/375; 446/381; 446/383; 446/370

[58] Field of Search ..... 446/375, 376, 379, 380, 446/381, 382, 383, 374, 373, 372, 371, 370, 369, 330

[56] References Cited

U.S. PATENT DOCUMENTS

| | | | |
|---|---|---|---|
| 280,986 | 7/1883 | Wishard | 446/370 |
| 1,590,898 | 6/1926 | McAuley | 446/370 |
| 3,955,309 | 5/1976 | Noble | 446/370 |
| 4,268,991 | 5/1981 | Cotey et al. | 446/383 X |
| 4,696,656 | 9/1987 | Torres et al. | 446/376 |

FOREIGN PATENT DOCUMENTS

| | | | |
|---|---|---|---|
| 2604563 | 8/1977 | Fed. Rep. of Germany | 446/376 |
| 1571352 | 7/1980 | United Kingdom | 446/370 |
| 1585330 | 2/1981 | United Kingdom | 446/376 |
| 2170725 | 8/1986 | United Kingdom | 446/376 |
| 2197800 | 6/1988 | United Kingdom | 446/373 |
| 2201899 | 9/1988 | United Kingdom | 446/330 |

*Primary Examiner*—Robert A. Hafer
*Assistant Examiner*—D. Neal Muir
*Attorney, Agent, or Firm*—Larson and Taylor

[57] ABSTRACT

A doll or similar toy is divulged comprising a flexible body (1) and rigid or semi-rigid members (5, 6). This doll comprises, embedded in its body (1), at least one metal rod (7) each end of which carries a rigid ball (8), each ball being capped with slight clamping by a rigid shell (9) fast with one of the members (5, 6) so as to form an easy fit articulation for this member.

4 Claims, 1 Drawing Sheet

FLEXIBLE BODIED DOLLS

BACKGROUND OF THE INVENTION

The invention relates to dolls or similar toys, such as plush animals representing living beings and comprising a flexible body formed of a fabric envelope stuffed with fibres and rigid or semi-rigid members generally formed from a moulded plastic material.

Such toys will be designated hereafter by the general term "dolls" for the sake of simplicity and of course in a non limitative way.

In known dolls of the kind in question, the members are generally connected to the flexible body by a single line of sewing or adhesive which assumes a fastening role but no relative holding role: these members hang then along the body, except in the case of a tight assembly in which they occupy a practically invariable position with respect to the body.

To make the dolls in question such that at least two of their members are smoothly articulated with respect to the body, i.e. occupy readily modifiable stable positions with respect to said body, it has already been proposed (Luxembourg patent No. 55 186) to embed in said body a framework having projecting portions in the form of at least partial balls intended to be capped with an easy fit by shells integral with the members.

But the frames in question, generally formed from a moulded plastic material, were expensive, which inadmissibly increased the overall price of the dolls considered, which was generally very low.

The purpose of the invention is especially to overcome this drawback by providing, for the frames, a very economic construction which is very easy to adapt to dolls of different dimensions.

SUMMARY OF THE INVENTION

For this, the frames in question are essentially characterized in accordance with the invention in that they are in the form of at least one rod formed by a metal wire having a section between 3 and 13 $mm^2$, covered or not by a plastic material sheath, which rod ends at at least one of its ends in a ball.

In preferred embodiments, recourse is further had to one and/or other of the following arrangements:

- the rod extends along a sinuous path including a U,
- the path of the rod has the general shape of a capital omega,
- the frame comprises two rods of the above kind each serving as an articulation support for two members, one of the two rods being associated with the articulation of the two arms and the other with the articulation of the two legs,
- the above two rods are assembled rigidly together,
- the body of the doll contains an additional rigid rod of the above kind, one end of which carries a ball serving as easy fit articulation for the head of the doll, said rod being assembled rigidly to at least one rod associated with the articulation of the members.

The invention comprises, apart from these main arrangements, certain other arrangements which are preferably used at the same time and which will be more explicitly discussed hereafter.

BRIEF DESCRIPTION OF THE DRAWINGS

In what follows, a preferred embodiment of the invention will be described with reference to the accompanying drawings in a way which is of course in no wise limitative.

DETAILED DESCRIPTION OF THE PREFERRED EMBODIMENTS

Figure 1:
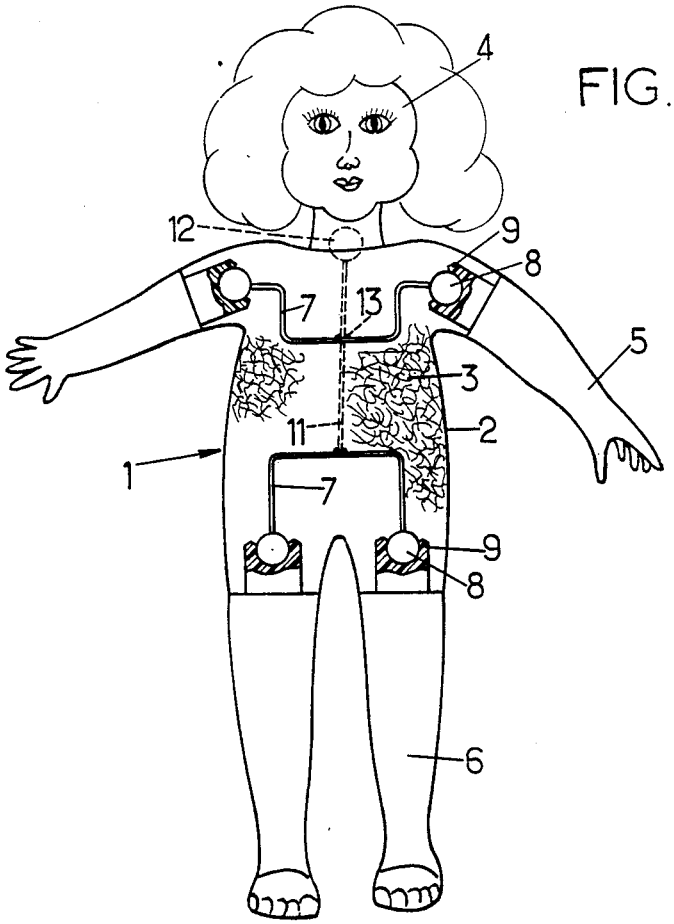
FIG. 1, of these drawings, shows schematically a doll with flexible body and articulated members formed in accordance with the invention.

In a way known per se, the doll comprises:

- a flexible body 1 formed of an envelope 2, made in particular from a fabric, filled with a mass of stuffing or padding 3 formed more particularly from synthetic fibres or wadding,
- a head 4 connected to this body 1, in particular by sewing or bonding,
- four rigid or semi-rigid members, made in particular from moulded plastic material, namely two arms 5 and two legs 6.

For articulating the two arms 5 and/or the two legs 6 with an easy fit with respect to to body 1, the invention comprises:

- a frame or framework in the form of a small dumbbell, formed of a rigid but slightly deformable rod, both ends of which carry two rigid balls 8,
- and two rigid shells 2 adapted to cap the balls 8 with slight clamping so as to be able to slide thereagainst with friction, said shells being fixed respectively to the ends to be articulated of the two members 5, 6 concerned.

Rod 7 is advantageously formed by a metal wire having a cross section between 3 and 13 $mm^2$ : if it a circular section, as is the preferred case, its diameter is therefore between 2 and 4 mm, limits included, being preferably about 3 mm.

Figure 2:
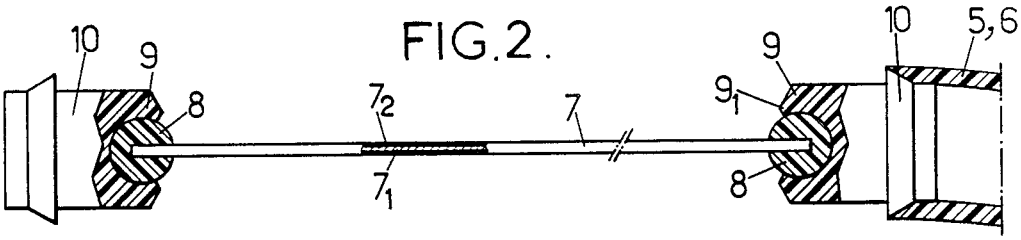
FIG. 2 shows on a larger scale, with sectioned portions, a component of this doll.

Said wire is made more particularly from steel, but it could also be an insulated electric wire, namely comprising a metal core $7_1$ (FIG. 2) and a plastic material sheath $7_2$ : by way of example, the core is made from copper, with a polyvinyl chloride sheath.

Rod 7 is long enough for the two balls 8 which it carries at its ends to be disposed in the positions of the articulations of the arms or legs of the doll, even after deformation of said rod along a sinuous path for holding it firmly in position inside the padding 3.

This length is generally between 10 and 20 cm.

Balls 8 are advantageously obtained by injecting a hard plastic material such as a polyamide and their diameter is generally between 10 and 15 mm.

They are mounted on the ends of rod 7 in any desirable way, in particular by being moulded over or by partial introduction of said ends in complementary recesses of the balls, in particular with interpositioning of an adhesive layer.

Shells 9 are made from a plastic material more flexible than the balls, particularly from polyvinyl chloride, polyethylene or polypropylene.

The inner surface of the cavity of each shell 9 has the form of a partial sphere whose diameter is equal to or very slightly less than that of balls 8.

This cavity opens outwardly at the level of a circular lip $9_1$ forming a slightly restricted opening: thus, each shell 9 may be force fitted on a ball 8 by a slight momentary expansion of lip $9_1$ followed immediately by its resilient return to its normal shape.

After such fitting, the position of shell 9 with respect to the overlapped ball 8 is stable, but it may be readily modified, the relative shell-ball movements being braked by the easy fit of the two mutually juxtaposed spherical surfaces of these two elements.

Each shell 9 is connected to a rigid base 10 which may be integrally moulded therewith and against which is fixed a member (5 or 6) of the doll, in particular by a tight and/or bonded fit.

To manufacture a doll having the above described components, the procedure is as follows.

Each ball frame is bent along a sinuous path such as a U or a capital omega, so that the centres of the two balls of each frame are spaced mutually apart by the desired distance and so that the rod end terminating in each ball emerges, on the face of this ball, the furthest away from the member to be articulated.

Then each ball is capped by the shell 9 associated with each member 5, 6, by the above mentioned snap-fit effect with momentary resilient expansion of the corresponding lip.

Then the body of the doll, namely the mass of fibres or similar forming padding 3 as well the envelope 2 containing and defining this pad, is positioned about the ball frame, preferably in a tight relation.

Of course, envelope 2 is formed with the openings required for letting the members 5, 6 pass therethrough: the apertures existing between the members and the openings are then filled in in any desirable way, for example by lines of sewing or bonding.

The doll is then finished.

Each ball 8 of a given frame is then exactly positioned therein with respect to the other ball of the same frame, and the member articulated to this ball may occupy a plurality of distinct stable positions offset angularly from each other about the centre of said ball.

The doll obtained has then both the advantages of softness, flexibility and lightness of flexible bodied dolls and that, of rigid dolls, which is the possibility of conferring on their different members relatively stable positions easy to modify.

It should be further noted that, because of its deformability and its positioning during assembly, a given ball frame of the above kind may be used not only for articulating the arms but also for articulating the legs of the same doll and may be adapted to dolls of very different dimensions.

Following which and whatever the embodiment adopted, a doll is finally obtained whose construction and advantages are sufficiently clear from the foregoing.

As is evident, and as it follows moreover from what has gone before, the invention is in no wise limited to those of its modes of application and embodiments which have been more especially considered; it embraces, on the contrary, all variants thereof, particularly:

those in which only one of the two above described ball frames is used, being associated with the articulation of the two arms only or with that of the two legs only, those in which the two balls of the same frame are associated respectively with the articulation of one arm and that of one leg, those in which one at least of the two ball frames is deformed along a sinuous path different from those described above, extending for example in the form of a V or along a three dimensional line, those in which, with the doll considered having two ball frames of the above described kind, the latter are assembled rigidly together, for example by common twisting of their central portions then juxtaposed side by side, or by means of a piece of wire or other solid intermediate body, and those in which the body of the doll contains, in addition to at least one ball frame of the above described kind, an additional rigid rod such as shown with broken lines at 11 in FIG. 1, one end of said rod carrying a rigid ball 12 associated like the above balls 8 with means forming therewith an easy fit articulation, such articulation being associated with the head of the doll and said rod 11 being assembled rigidly on said ball frame(s), for example by spot welds 13.

I claim:

1. A stuffed doll comprising a flexible body, rigid members and a frame embedded in the body, said frame having projecting portions in the form of at least partial balls capped with an easy fit by shells which are connected to the respective member, wherein the framework is in the form of at least one rod formed by a metal wire and having a cross section of between 3 and 13 $mm^2$, which rod extends along a sinous path in a generally "U" shape and terminates at at least one of its ends in a said ball.

2. A doll according to claim 1, wherein the frame comprises two of said rods, each rod serving as an articulation support for two members, said two members being either two arms or two legs, one of the two rods being associated with the articulation of the two arms and the other with the articulation of the two legs, the two said rods being rigidly connected together.

3. A doll according to claim 1, wherein the said body contains an additional rigid rod, one end of which carries a ball serving as an easy fit articulation for a head, said rod being rigidly connected to at least one of the rods associated with the said members.

4. A doll according to claim 1, wherein the metal wire is covered by a plastic sheath.

* * * * *